US009564047B2

(12) United States Patent
Wu

(10) Patent No.: US 9,564,047 B2
(45) Date of Patent: Feb. 7, 2017

(54) TRAFFIC MONITORING SYSTEM AND TRAFFIC MONITORING METHOD IN WHICH A TRAFFIC CONTROL CENTER CONFIGURED A THREE DIMENSIONAL TRAFFIC IMAGE

(71) Applicants: HONG FU JIN PRECISION INDUSTRY (ShenZhen) CO., LTD, Shenzhen (CN); HON HAI PRECISION INDUSTRY CO., LTD., New Taipei (TW)

(72) Inventor: Wei-Feng Wu, Shenzhen (CN)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 119 days.

(21) Appl. No.: 14/560,072

(22) Filed: Dec. 4, 2014

(65) Prior Publication Data

US 2015/0254976 A1 Sep. 10, 2015

(30) Foreign Application Priority Data

Mar. 6, 2014 (CN) ..... 2014 1 0079941

(51) Int. Cl.

*G08G 1/01* (2006.01)
*G08G 1/017* (2006.01)
*G08G 1/04* (2006.01)

(52) U.S. Cl.

CPC ..... *G08G 1/0125* (2013.01); *G08G 1/017* (2013.01); *G08G 1/0116* (2013.01);
(Continued)

(58) Field of Classification Search

CPC .. G08G 1/0125; G08G 1/0116; G08G 1/0133; G08G 1/0104; G08G 1/0141; G08G 1/017; G08G 1/04; G08G 1/096716; G08G 1/096775; G08G 1/096783
(Continued)

(56) References Cited

U.S. PATENT DOCUMENTS 5,396,429 A * 3/1995 Hanchett ..... G08G 1/0969 340/910
6,072,421 A * 6/2000 Fukae ..... G01S 13/876 342/126
(Continued)

*Primary Examiner* — Benjamin C Lee
*Assistant Examiner* — Stephen Burgdorf
(74) *Attorney, Agent, or Firm* — Zhigang Ma

(57) ABSTRACT

A traffic monitoring system includes a plurality of road monitoring devices and a traffic control center electronically coupled to the road monitoring devices. Each road monitoring device has specific transmittable position information stored therein. The traffic control center has stored transmittable images of a plurality of vehicle types and stored transmittable images of the plurality of roads to be monitored. When one or more vehicles passes one of the road monitoring devices, the road monitoring device receives a vehicle identification code from each vehicle, calculates position information of each vehicle and transmits the road monitoring device position information, each vehicle identification code and the vehicle position information for each vehicle to the traffic control center. The traffic control center configures a three dimensional traffic image from all of the vehicle images of the one or more vehicles passing the one of the road monitoring devices.

20 Claims, 6 Drawing Sheets

(52) U.S. Cl.
CPC ..... *G08G 1/0133* (2013.01); *G08G 1/0141* (2013.01); *G08G 1/04* (2013.01)

(58) Field of Classification Search
USPC ..... 340/937, 905, 907, 910, 933, 988,340/995.15; 382/104; 701/117, 118, 119
See application file for complete search history.

(56) References Cited

U.S. PATENT DOCUMENTS

| | | | | |
|---|---|---|---|---|
| 6,091,956 | A * | 7/2000 | Hollenberg | G06Q 30/02 455/456.5 |
| 6,388,581 | B1 * | 5/2002 | Barker | G07B 15/063 340/928 |
| 8,781,736 | B2 * | 7/2014 | Cera | G08G 1/09 340/995.13 |
| 9,224,293 | B2 * | 12/2015 | Taylor | G08G 1/08 |
| 2006/0253246 | A1 * | 11/2006 | Cera | G08G 1/096861 701/117 |
| 2009/0225502 | A1 * | 9/2009 | Cheng | G06F 1/1601 361/679.01 |
| 2010/0070175 | A1 * | 3/2010 | Soulchin | G06T 17/05 701/414 |
| 2011/0183732 | A1 * | 7/2011 | Block | G06Q 30/02 463/1 |
| 2012/0106800 | A1 * | 5/2012 | Khan | G06K 9/00651 382/104 |
| 2013/0201011 | A1 * | 8/2013 | Nieuwland | G07B 15/063 340/425.5 |
| 2013/0293422 | A1 * | 11/2013 | Guner | G08G 1/017 342/386 |

* cited by examiner

TRAFFIC MONITORING SYSTEM AND TRAFFIC MONITORING METHOD IN WHICH A TRAFFIC CONTROL CENTER CONFIGURED A THREE DIMENSIONAL TRAFFIC IMAGE

FIELD

The subject matter herein generally relates to a traffic monitoring system and a traffic monitoring method.

BACKGROUND

A conventional traffic monitoring system is a video-based traffic monitoring system. A camera mounted on a structure, such as the streetlight pole, looking over the traffic scene serves as the sensor device for the capturing of traffic images. The captured analogue video images are then transmitted to a processor which converts the analogue video into digital form. The digitized images will then be processed and analyzed for the extraction of traffic information using image processing techniques. The extracted information can then be transmitted to an external user, such as a traffic control center, for traffic monitoring/control.

BRIEF DESCRIPTION OF THE DRAWINGS

Implementations of the present technology will now be described, by way of example only, with reference to the attached figures.

DETAILED DESCRIPTION

Figure 1:
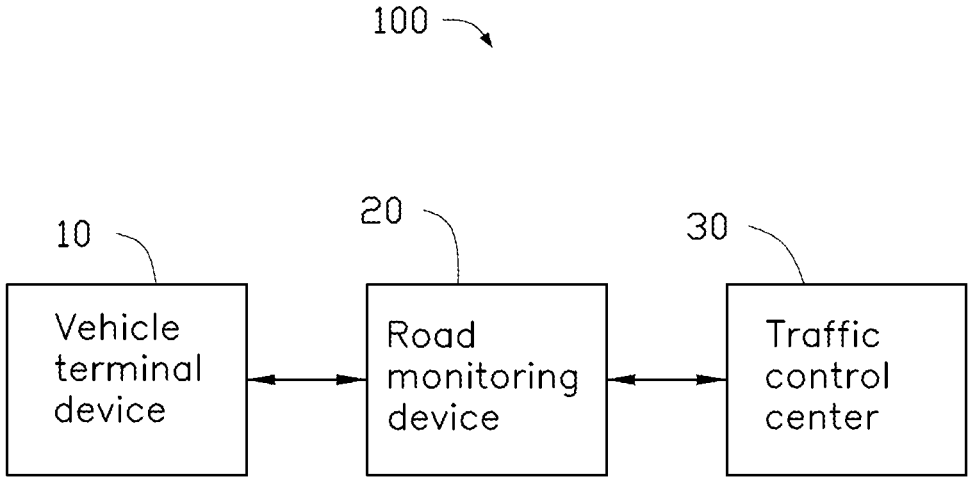
FIG. 1 is a diagrammatic view one embodiment of a traffic monitoring system.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" when utilized, means "including, but not necessarily limited to"; it specifically indicates open-ended inclusion or membership in the so-described combination, group, series and the like.

The present disclosure is described in relation to a traffic monitoring system and a traffic monitoring method.

FIG. 1 illustrates a traffic monitoring device 100 including a vehicle terminal device 10 mounted on a vehicle, one or more road monitoring devices 20 positioned along a road, and a traffic control center 30 electrically coupled to the road monitoring device 20.

Figure 2:
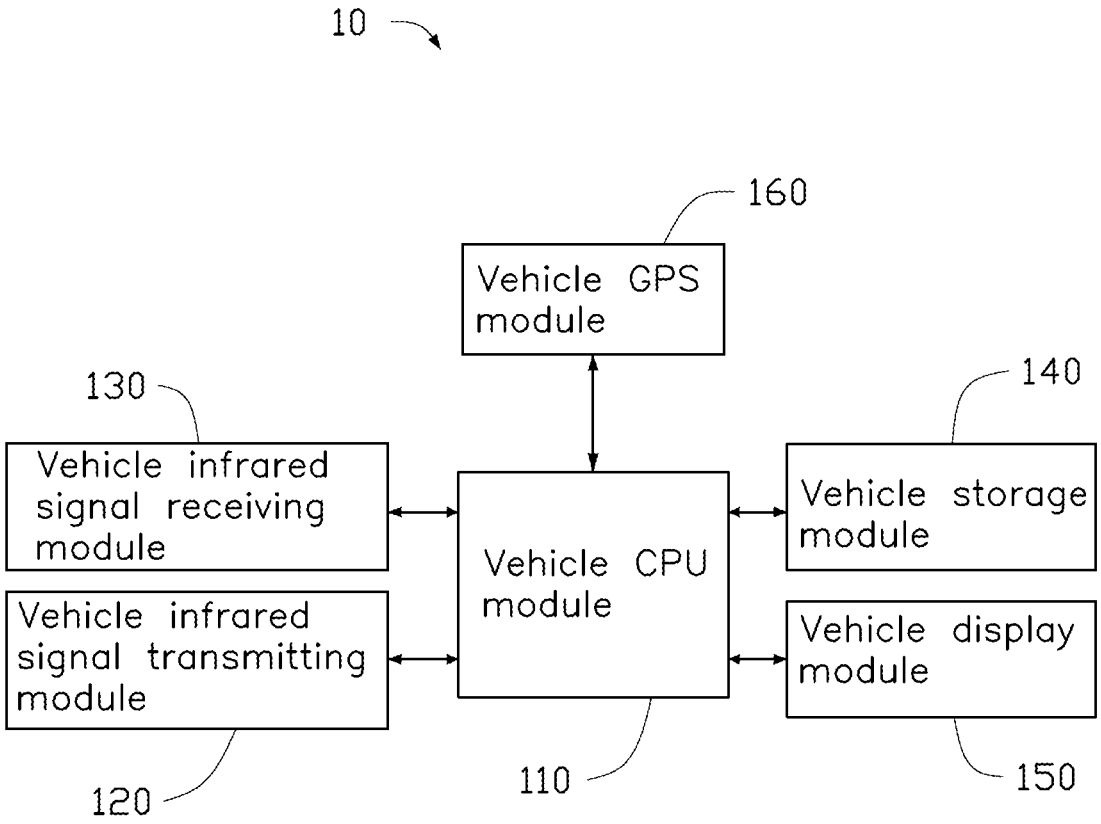
FIG. 2 is a diagrammatic view of a vehicle terminal device of the traffic monitoring system in FIG. 1.

FIG. 2 illustrates that the vehicle terminal device 10 can include a vehicle central processing unit (CPU) module 110, and a vehicle infrared signal transmit module 120, a vehicle infrared signal receiving module 130, a vehicle memory module 140, a vehicle display module 150, and a vehicle global position system (GPS) module 160 electrically connected to the vehicle CPU module 110. The vehicle terminal devices 10 can be mounted on all of the vehicles. The vehicle infrared signal transmit module 120 can be configured to transmit infrared signal, and the vehicle infrared signal receiving module 130 can be configured to receive the infrared signal. The vehicle memory module 140 can be configured to store a vehicle identification code of this vehicle, three dimensional images of all styles of vehicles, and three dimensional images of roads. The vehicle identification code is unique and can include all registration information of the vehicle, such as color, model, manufacture, vehicle made date, registration area, and information of vehicle owner. The vehicle CPU module 110 can be configured to control the vehicle infrared signal transmit module 120 and the vehicle infrared signal receiving module 130, process the infrared signal, and supply information stored in the vehicle memory module 140 to the display module 150. The vehicle GPS module 160 can be configured to acquire a GPS time.

Figure 3:
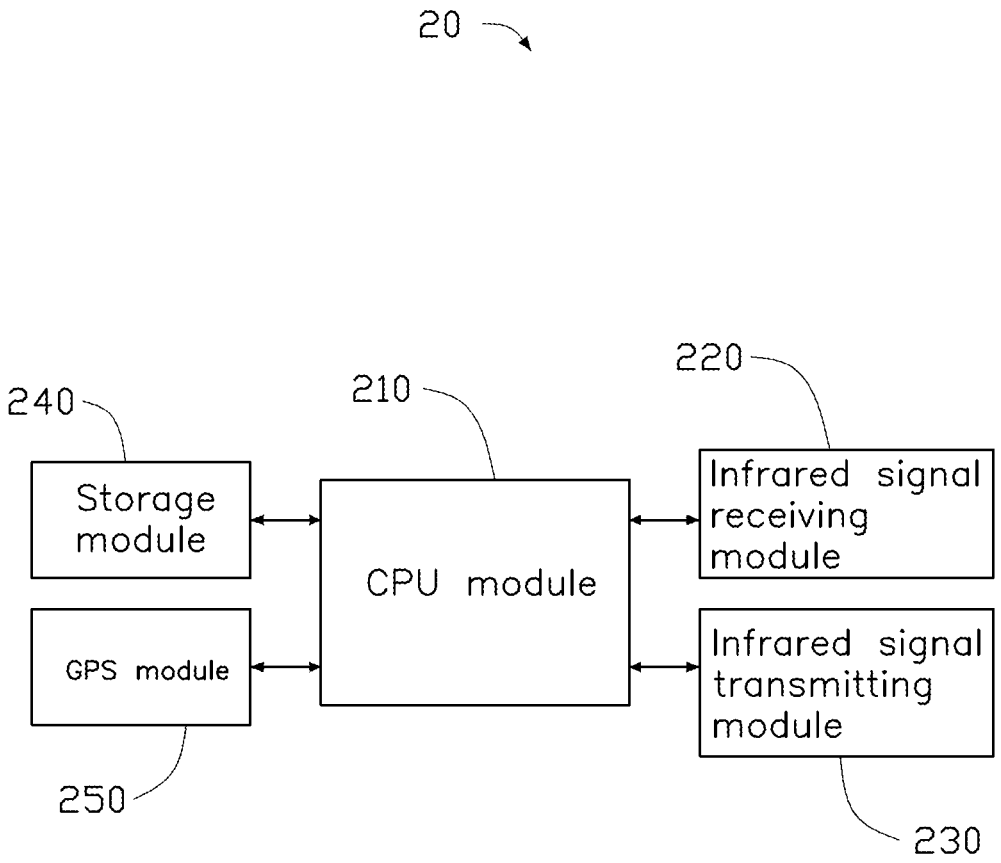
FIG. 3 is a diagrammatic view of a road monitoring device of the traffic monitoring system in FIG. 1.

FIG. 3 illustrates that the road monitoring device 20 can include a CPU module 210, and an infrared signal receiving module 220, an infrared signal transmitting module 230, a memory module 240, and a GPS module 250 electrically connected to the CPU module 210. The CPU module 210 can be configured to control the infrared signal receiving module 220 and the infrared signal transmitting module 230, and calculate vehicle position information according to the infrared signal received by the infrared signal receiving module 220. The memory module 240 can be configured to store the position information of the road monitoring device 20. The GPS module 250 can be configured to acquire GPS time. The road monitoring device 20 can be coupled to the traffic control center 30. In at least one embodiment, the road monitoring device 20 can be electrically connected to the traffic control center 30 by optical fiber. The road monitoring device 20 can be communicated with the vehicle terminal device 10 through the infrared signal transmitting/receiving modules. The road monitoring device 20 can be one or more, and positioned along the monitored road.

Figure 4:
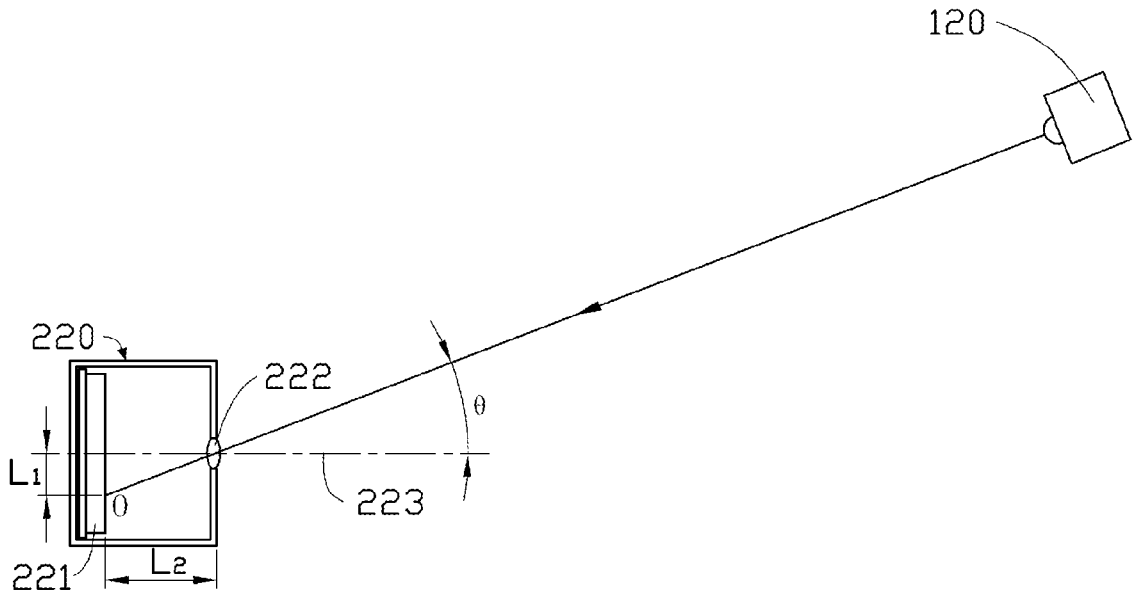
FIG. 4 is a diagrammatic view of positioning vehicle of the traffic monitoring system in FIG. 1.

FIG. 4 illustrates that the infrared signal receiving module 220 can include a receiving chip 221 and a receiving hole 222 opposite the receiving chip 221. The receiving hole 222 can be arranged coaxially with a central axis 223 of the receiving chip 221. The receiving chip 221 can receive the signal transmitted from the vehicle infrared signal transmit module 120 via the receiving hole 222.

Figure 5:
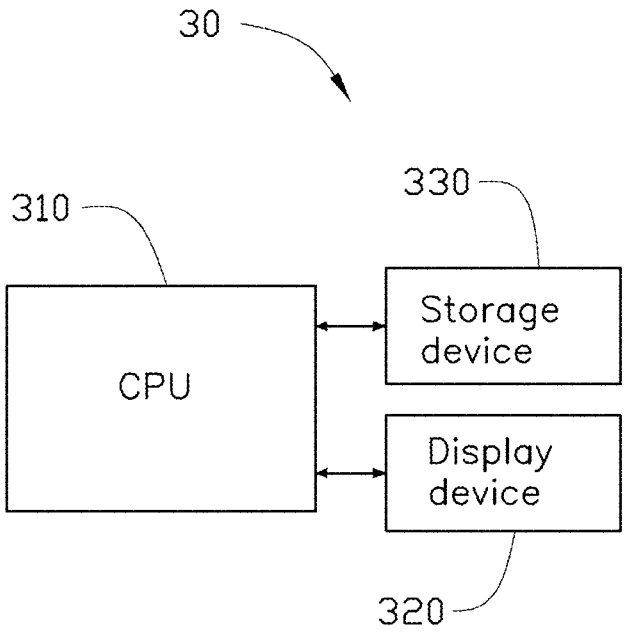
FIG. 5 is a diagrammatic view of a traffic control center of the traffic monitoring system in FIG. 1.

FIG. 5 illustrates that the traffic control center 30 can include a CPU 310, a memory device 320, and a display device 330. The CPU 310 can be configured to process the position information of the road monitoring device 20, the vehicle information, and the vehicle position information. The storage device 320 can be configured to store three dimensional images of all styles of vehicles and roads. The CPU 310 can call out the three dimensional images of the vehicle and the road according to the vehicle information and the position information of the road monitoring device 20, and configure a three dimensional image including the vehicles images and the roads images. The display device 330 can be configured to display the three dimensional traffic images.

In at least one embodiment, the vehicle storage module 140, the storage module 240, and the storage device 320 can be selected from a hard disk, a flash memory, and a memory card.

Figure 6:
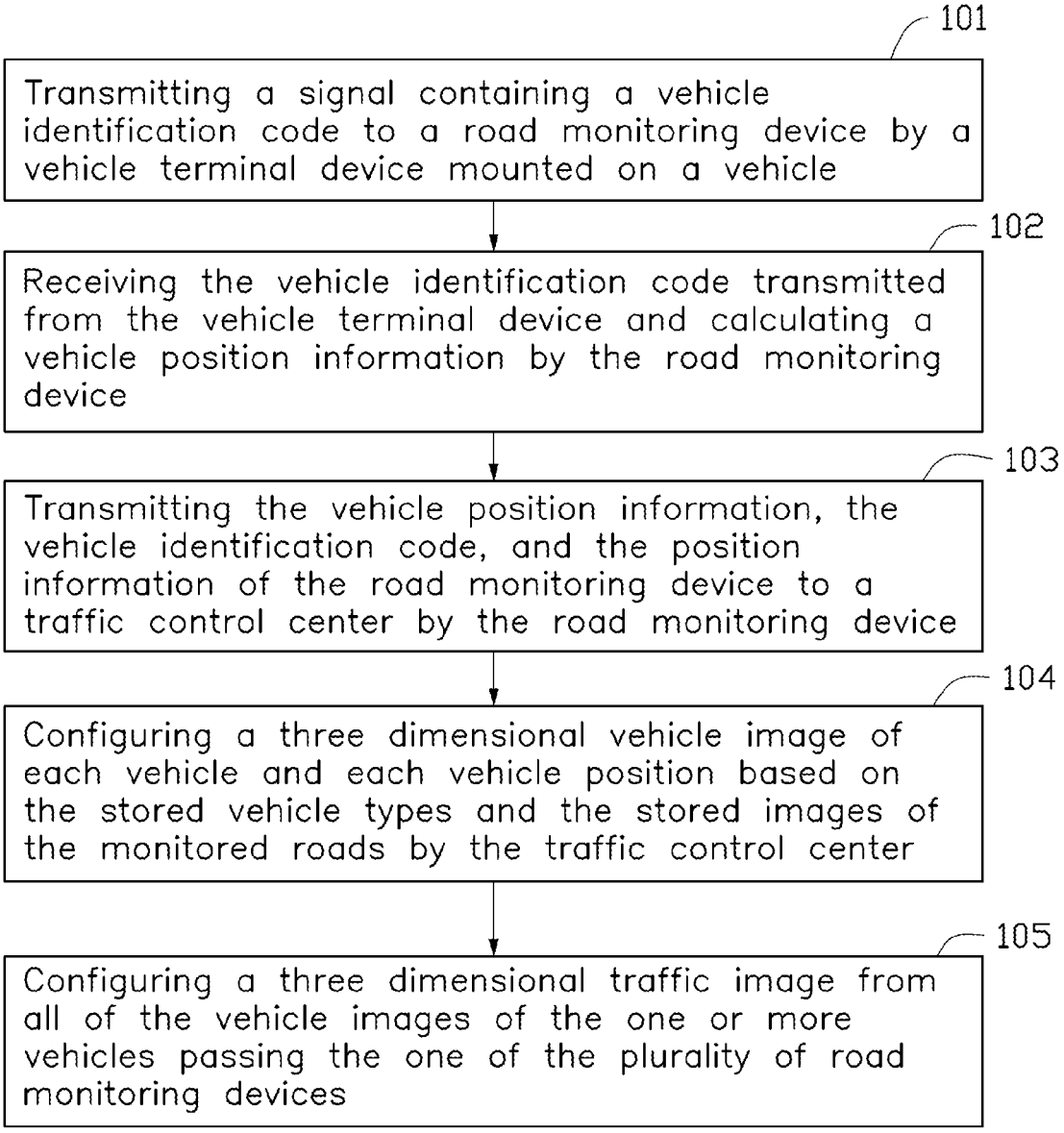
FIG. 6 is flowchart of an embodiment of a method of monitoring traffic.

FIG. 6 illustrates a method for monitoring traffic using the traffic monitoring system 100. Referring to FIG. 6, a flowchart is presented in accordance with an example embodiment which is being thus illustrated. The example method is provided by way of example, as there are a variety of ways to carry out the method. The method described below can be carried out using the configurations illustrated in FIGS. 1 through 5, for example, and various elements of these figures are referenced in explaining example method. Each block shown in FIG. 6 represents one or more processes, methods or subroutines, carried out in the example method. Additionally, the illustrated order of blocks is by example only and the order of the blocks can change according to the present disclosure. The example method can begin at block 101.

At block 101, the vehicle terminal device 10 can enter a standby mode after the vehicle started. When one or more vehicles pass one of the plurality of the road monitoring device 20, the vehicle GPS module 160 can acquire a GPS time synchronize with the road monitoring device 20, and the vehicle infrared signal transmit module 120 of the vehicle terminal device 10 can transmit an infrared signal to the road monitoring device 20 positioned on the road. The infrared signal can contain the vehicle identification code and a signal transmitting time of $T_0$.

At block 102, the infrared signal receiving module 220 of the road monitoring device 20 can receive the infrared signal transmitted by the vehicle terminal device 10. At the same time, the CPU module 210 can calculate accurate spatial locations of the vehicle for precision positioning.

FIG. 4 illustrates the positioning principle. In positioning an angle between the vehicle and the road monitoring device 20, the signal transmitted by the infrared signal transmitting module 120 can be specific code sequences, and pass through the receiving hole 222, and then received by the receiving chip 221 at a receiving point O. The CPU module 210 can distinguish the specific code sequences and exclude other clutter infrared signals. The CPU module 210 can get a two-dimensional coordinate of the receiving point O relative to the central axis 223, and then calculate a distance L1 between the receiving point O and the central axis 223. As a distance L2 between the receiving chip 221 and the receiving hole 222 can be predetermined, the CPU module 210 can calculate an angle θ formed between the vehicle infrared signal transmitting module 120 and the central axis 223 of the receiving chip 221 by $\theta=\arctan(L1/L2)$. Therefore, the angle between the vehicle and the road monitoring device 20 can be calculated.

In positioning a distance between the vehicle and the road monitoring device 20, the vehicle infrared signal transmitting module 120 can transmit the signal including the signal transmitting time of $T_0$, and the infrared signal receiving module 220 can receive the signal and record the signal receiving time of T1. Then, the CPU module 210 of the road monitoring device 20 can calculate an linear distance between the vehicle transmitting module 120 and the road monitoring device 20 by measuring the differential time between signal transmitting time T0 and signal receiving time T1. Therefore, the vehicle position information can be calculated.

At block 103, the position information of the road monitoring device 20 stored in the storage module 240, the vehicle identification code, and the calculated vehicle position information can be transmitted to the traffic control center 30 by the road monitoring device 20. The traffic control center 30 can receive the signal including the position information of the road monitoring device 20 and the vehicle, and the vehicle identification code, and then call out the corresponding three dimensional images of the corresponding vehicle mode and the road according to the vehicle identification code and the position information of the road monitoring device 20. At block 104, The CPU 310 of the traffic control center 30 can configure a three dimensional image of each vehicle and each vehicle position based on the stored vehicle types and the stored images of the monitored roads.

At block 105, the traffic monitoring center 30 can configure a three dimensional traffic image from all of the vehicle images of the one or more vehicles passing the one of the plurality of road monitoring devices 20. The three dimensional image of the road can be displayed on the display module 330, thus the traffic of the road can be real time monitored. The three dimensional images of the traffic can be zoom in and out, and rotated.

The signal of the composited three dimensional image of the traffic can be transmitted to the road monitoring device 20 by the traffic control center 30, and the vehicle infrared signal receiving module 130 of each vehicle can receive the signal transmitted by the road monitoring device 20. The vehicle CPU module 110 can process the signal and call out the three dimensional images of all styles of vehicles and the road, and then configure a three dimensional images of the traffic. The vehicle display module 150 can display the three dimensional images of the traffic, so drivers can watch the three dimensional images of the traffic on the vehicle display module 150 especially in poor visibility conditions.

The traffic monitoring system 100 can further send warning signals to vehicles through the road monitoring device 20 when a traffic accident occurred, or a traffic violation occurred. The traffic monitoring system 100 can be connected with the Internet, and vehicle owners can look at the traffic. Moreover, the vehicle terminal device 10 can send a signal to the monitor center 30 when the vehicle is broken.

The traffic monitoring system 100 can identify the vehicles, so the traffic control center 30 can send different signals to each road monitor device 20, and the road monitor device 20 can send corresponding signal to the vehicles on the road. Therefore, the vehicles on specific road can be guided.

In other embodiments, the infrared signal receiving module 220, the infrared signal transmitting module 230, and the storage module 240 of the road monitoring device 20 can be controlled by the CPU 310 of the traffic control center 30.

The traffic monitoring system can receive signals transmitted by the vehicle terminal devices and accurately position the vehicles. The traffic monitoring system can configure three dimensional images of the traffic to monitor the traffic, send traffic signal to the vehicles, and the vehicles can composite three dimensional images of the traffic. The traffic monitoring system can realize vehicle tracking and vehicle navigation. As the three dimensional images are stored in the traffic control center and the vehicle terminal devices, they can be called out by sending and receiving signal, and the traffic monitoring system can be high intelligent and low-cost.

The embodiments shown and described above are only examples. Many details are often found in the art such as the other features of a traffic monitoring system and a traffic monitoring method. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A traffic monitoring system for monitoring traffic on a plurality of roads, comprising:

one or more road monitoring devices, each road monitoring device positioned along a road and each road monitoring device having specific transmittable position information stored therein; and a traffic control center electronically coupled to the one or more road monitoring devices, the traffic control center having stored transmittable three dimensional images of a plurality of vehicle types and stored transmittable three dimensional images of the plurality of roads to be monitored;

wherein, when one or more vehicles passes one of the plurality of road monitoring devices, the road monitoring device receives a vehicle identification code from each vehicle identifying the specific vehicle, the vehicle identification code being transmitted from a vehicle terminal device mounted in each vehicle;

wherein, when the road monitoring device receives each specific vehicle identification code, the road monitoring device calculates position information of each vehicle and transmits the road monitoring device position information, each vehicle identification code and the calculated vehicle position information for each vehicle to the traffic control center;

wherein, the traffic control center calls out one or more stored images each with the vehicle type corresponding to each of the one or more vehicles specified by the one or more vehicle identification codes, calls out a particular image of the road corresponding to the road monitoring device position, and configures a three dimensional vehicle image of each vehicle to be respectively positioned in the particular monitored road image based on the stored images of the one or more vehicle types, the one or more stored images of the monitored roads, and the position information of each vehicle;

wherein, the traffic control center configures a three dimensional traffic image of the road at the road monitoring device position from all of the vehicle type images of the one or more vehicles passing the particular one of the plurality of the road monitoring devices.

2. The traffic monitoring system as claimed in claim 1, wherein the traffic control center is capable of transmitting a signal of the three dimensional traffic image to a vehicle terminal device.

3. The traffic monitoring system as claimed in claim 1, wherein, each vehicle terminal device comprises a vehicle central processing unit (CPU) module, and a vehicle infrared signal transmitting module, a vehicle storage module, a vehicle global position system (GPS) module electrically connected to the vehicle CPU module;

the vehicle GPS module is configured to acquire a GPS time synchronize with a road monitoring device.

4. The traffic monitoring system as claimed in claim 3, wherein, each vehicle terminal device further comprises a vehicle infrared signal transmitting module and a vehicle display module electrically connected to the vehicle CPU module;

the vehicle storage module is configured to store the vehicle identification code, images of the plurality of vehicle types and images of the plurality of roads to be monitored.

5. The traffic monitoring system as claimed in claim 4, wherein the vehicle storage module is selected from a hard disk, a flash memory, and a memory card.

6. The traffic monitoring system as claimed in claim 1, wherein, each road monitoring device comprises a CPU module, an infrared signal transmitting module, an infrared signal receiving module, a storage module, and a GPS module electrically connected to the CPU module;

position information is stored in the storage module, and the GPS module is configured to acquire a GPS time.

7. The traffic monitoring system as claimed in claim 6, wherein the storage module is selected from a hard disk, a flash memory, and a memory card.

8. The traffic monitoring system as claimed in claim 6, wherein, the infrared signal receiving module comprises a receiving chip and a receiving hole opposite to the receiving chip;

the receiving hole is arranged coaxially with a central axis of the receiving chip; and the receiving chip is configured to receive a signal transmitted from the vehicle infrared signal transmit module via the receiving hole.

9. The traffic monitoring system as claimed in claim 1, wherein, the traffic control center comprises a CPU, and a storage device and a display device electrically connected to the CPU;

the plurality of images of types of vehicles and roads to be monitored are stored as three dimensional imaged in the storage device.

10. The traffic monitoring system as claimed in claim 9, wherein the storage device is selected from a hard disk, a flash memory, and a memory card.

11. A traffic monitoring method comprising:

storing transmittable three dimensional images of a plurality of vehicle types and transmittable three dimensional images of a plurality of roads to be monitored at a traffic control center;

for each vehicle of a plurality of vehicles passing a particular one of a plurality of road monitoring devices: receiving a vehicle identification code transmitted from a vehicle terminal device mounted on the vehicle and calculating a vehicle position information by the particular road monitoring device positioned along a road;

transmitting the vehicle position information, the vehicle identification code, and the position information of the particular road monitoring device to the traffic control center by the particular road monitoring device;

calling out stored images corresponding to the vehicle type of the vehicle and the road at the particular road monitoring device position along the road according to the vehicle identification code and the position information of the particular road monitoring device;

configuring a three dimensional vehicle image of the vehicle and the vehicle position based on the stored image of the vehicle type, the stored image of the monitored road at the particular road monitoring device position along the road, and the position information of the vehicle by the traffic control center; and configuring a three dimensional traffic image from all of the vehicle images of the plurality of vehicles passing the particular road monitoring device.

12. The traffic monitoring method as claimed in claim 11, further comprising transmitting a signal of the configured three dimensional traffic image to each vehicle by the traffic control center.

13. The traffic monitoring method as claimed in claim 11, wherein, each vehicle terminal device comprises a vehicle CPU module, and a vehicle infrared signal transmitting module, a vehicle storage module, a vehicle GPS module electrically connected to the vehicle CPU module;

the vehicle GPS module is configured to acquire a GPS time synchronize with the particular road monitoring device.

14. The traffic monitoring method as claimed in claim 13, wherein, each vehicle terminal device further comprises a vehicle infrared signal transmitting module and a vehicle display module electrically connected to the vehicle CPU module;

the vehicle storage module is configured to store the vehicle identification code, images of the plurality of vehicle types and images of the plurality of roads to be monitored.

15. The traffic monitoring method as claimed in claim 11, wherein, each road monitoring device comprises a CPU module, an infrared signal transmitting module, an infrared signal receiving module, a storage module, and a GPS module electrically connected to the CPU module;

position information is stored in the storage module; and the GPS module is configured to acquire a GPS time.

16. The traffic monitoring method as claimed in claim 15, wherein, the infrared signal receiving module comprises a receiving chip and a receiving hole opposite to the receiving chip;

the receiving hole is arranged coaxially with a central axis of the receiving chip;

the receiving chip is configured to receive a signal transmitted from the vehicle infrared signal transmit module via the receiving hole.

17. The traffic monitoring method as claimed in claim 16, wherein, the signal transmitted by the vehicle terminal device passes through the receiving hole at an angle $\Theta$ between the vehicle and the road monitoring device, and then reaches to the receiving chip at a receiving point;

a first distance of L1 between the receiving point and the central axis is calculated, and a second distance of L2 between the receiving chip and the receiving hole is calculated;

the angle $\Theta$ is calculated by $\Theta$=arctan(LI/L2).

18. The traffic monitoring method as claimed in claim 11, wherein a distance between a vehicle and a road monitoring device is calculated by measuring a differential time between a signal transmitting time when the vehicle transmits a signal to the road monitoring device and a signal receiving time when the road monitoring device receives the signal transmitted by the vehicle.

19. The traffic monitoring method as claimed in claim 11, wherein, the traffic control center comprises a CPU, and a storage device and a display device electrically connected to the CPU;

the plurality of images of types of vehicles and roads to be monitored are stored as three dimensional imaged in the storage device.

20. A traffic monitoring system for monitoring traffic on a plurality of roads, comprising:

one or more road monitoring devices, each road monitoring device positioned along a road and each road monitoring device having specific transmittable position information stored therein; and a traffic control center electronically coupled to the one or more road monitoring devices, the traffic control center having stored transmittable three dimensional images of a plurality of vehicle types and stored transmittable three dimensional images of the plurality of roads to be monitored;

wherein, when one or more vehicles passes one of the plurality of road monitoring devices, the road monitoring device receives a vehicle identification code from each vehicle identifying the specific vehicle, the vehicle identification code being transmitted from a vehicle terminal device mounted in each vehicle;

wherein, when the road monitoring device receives each specific vehicle identification code, the road monitoring device calculates position information of each vehicle and transmits the road monitoring device position information, each vehicle identification code and the calculated vehicle position information for each vehicle to the traffic control center;

wherein, the traffic control center configures a three dimensional vehicle image of each vehicle to be respectively positioned in a particular monitored road image based on the stored images of the plurality of vehicle types and the stored images of the plurality of monitored roads;

wherein, the traffic control center configures a three dimensional traffic image of the road at the road monitoring device position from all of the vehicle type images of the one or more vehicles passing the particular one of the plurality of road monitoring devices;

wherein each road monitoring device comprises a central processing unit (CPU) module, an infrared signal transmitting module, an infrared signal receiving module, a storage module, and a global position system (GPS) module electrically connected to the CPU module; the position information is stored in the storage module, the GPS module is configured to acquire a GPS time; and wherein the infrared signal receiving module comprises a receiving chip and a receiving hole opposite to the receiving chip, the receiving hole is arranged coaxially with a central axis of the receiving chip, and the receiving chip is configured to receive a signal transmitted from the vehicle infrared signal transmit module via the receiving hole.

* * * * *